US005777284A

United States Patent [19]

Mohtasham

[11] Patent Number: 5,777,284

[45] Date of Patent: Jul. 7, 1998

[54] SAFETY SWITCH ASSEMBLY WITH A LATCH MECHANISM

[75] Inventor: Medi Mohtasham, Manchester, United Kingdom

[73] Assignee: E.J.A. Engineering plc, Lancaster, Great Britain

[21] Appl. No.: 669,334

[22] PCT Filed: Oct. 20, 1994

[86] PCT No.: PCT/GB94/02306

§ 371 Date: Oct. 21, 1996

§ 102(e) Date: Oct. 21, 1996

[87] PCT Pub. No.: WO95/18457

PCT Pub. Date: Jul. 6, 1995

[30] Foreign Application Priority Data

Dec. 24, 1993 [GB] United Kingdom ..... 9326394

[51] Int. Cl.[6] ..... H01H 27/00; H01H 1/52

[52] U.S. Cl. ..... 200/43.04; 200/61.62; 200/318

[58] Field of Search ..... 200/43.04, 43.16, 200/17 R, 61.62, 321, 323, 324, 318, 318.2, 573

[56] References Cited

U.S. PATENT DOCUMENTS

| | | | |
|---|---|---|---|
| 3,731,174 | 5/1973 | Harris | 318/485 |
| 4,524,251 | 6/1985 | Schulz | 200/42 R |
| 4,593,545 | 6/1986 | Terry et al. | 70/269 |
| 4,904,829 | 2/1990 | Berthaud et al. | 200/50 R |
| 5,488,207 | 1/1996 | Niwa et al. | 200/43.04 |
| 5,587,569 | 12/1996 | Mohtasham | 200/17 R |

FOREIGN PATENT DOCUMENTS

WO 90/08396 7/1990 WIPO .

*Primary Examiner*—Michael L. Gellner
*Assistant Examiner*—Michael J. Hayes
*Attorney, Agent, or Firm*—Loeb & Loeb LLP

[57] ABSTRACT

A safety switch assembly for use with a machinery guard enclosing kinetic machinery, comprises a housing, an electrical contact arrangement and a rotatable actuator cam contained within the homing for operating the electrical contact arrangement and spaced from the electrical contact arrangement. Radial pockets are formed in the actuator cam and extend inwardly of the periphery of the latter. An axially-movable rod connects the electrical contact arrangement and the actuator cam to operate the former in accordance with rotational movement of the latter. The housing defines at least one entry adjacent the actuator cam for insertion of an actuator into the housing to engage the radial pockets to rotate the actuator cam. Anti-rotational locking means releasably engage the actuator cam to prevent rotation of the latter and consequent operation of the electrical contact arrangement until a separation of the actuator cam and the anti-rotational locking means is effected by the actuator. A solenoid-operated claw is disposed alongside the actuator cam for engaging a locking formation of the actuator to secure the actuator in engagement with the actuator cam to maintain the electrical contact arrangement in a power supply ON condition. The actuator has lateraly-spaced limbs insertible between the actuator cam and the anti-rotational locking means axially to space same apart, and (ii) engageable with the actuator cam to rotate same axially to move the rod to operate the electrical contact arrangement. It also has a locking formation engageable by the solenoid-operated claw to secure the actuator in engagement with the actuator cam to maintain the electrical contact arrangement in the power supply ON condition.

2 Claims, 5 Drawing Sheets

SAFETY SWITCH ASSEMBLY WITH A LATCH MECHANISM

This invention relates to safety switch assemblies used especially but not exclusively in machinery guards enclosing kinetic machinery.

Known safety switch assemblies comprise a safety switch adapted to be fitted to an enclosure and an actuator adapted to be fitted to a door, gate or protective cover of the enclosure and insertable into the safety switch to turn ON the electrical power supply when the enclosure is closed by the door, gate or protective cover.

Known safety switches comprise a housing within which are mounted normally-open sets of contacts, one set of contacts being fixed, and the other being movable and carried by an axially-movable push rod. The push rod is spring-loaded to maintain the sets of contacts apart and the power supply consequently OFF.

The axially-movable rod is moveable by a rotatable cam of a cam arrangement normally disposed to prevent cam rotation and consequently to secure the rod in a power supply OFF position, but which is operable by the actuator to cause cam rotation and axial movement of the push rod to a power supply ON position.

It is known to supplement safety switch assemblies with a locking mechanism that locks the actuator in engagement with the safety switch. The objective is to provide an extra level of safety which positively prevents opening of the enclosure except in predetermined controlled conditions, for example actuation of a control which turns off machinery within the enclosure. In one known arrangement, the actuator is engaged by locking members that are pivotally supported by the housing and jammed in a locking position by a solenoid controlled member. This known arrangement requires relatively large locking components that occupy much valuable space and require a relatively powerful operating solenoid.

It is an object of the present invention to provide an improved safety switch assembly incorporating a locking mechanism.

According to the present invention there is provided a safety switch comprising electrical contacts movable from a power supply OFF position to a power supply ON position, an actuating cam adapted to be rotated about a predetermined axis by an actuator of a predetermined condition, rotation of the cam causing movement of a cam plunger which moves, the electrical contacts between the ON and OFF positions, and at least one locking member actuable between a locking position in which it engages the plunger such that when an attempt is made to withdraw the actuator from the switch movement of the cam plunger and consequent cam rotation is prevented and an unlocked position in which the cam plunger is released and the cam is free to rotate to allow withdrawal of the actuator.

Preferably the locking member is in the form of a pivotally mounted lever which has a locking end engageable with a locking surface of the cam plunger, and a tail end which is operable to pivot the lever into and out of the locking position.

There may be provided means for moving the locking member between the locked and unlocked positions which means may be for example a solenoid.

In a preferred embodiment the locking members co-operate with a sliding member which is operated by said means for moving, the locking members engaging in guide slots in the sliding member. The sliding member may be connected to the solenoid by a pivotal arm such that when the solenoid plunger is in an extended position the sliding member is moved to a first position in which the cam plunger is free to move and when the solenoid plunger is in a retracted position the sliding member is moved to a second position in which the cam plunger is locked.

The guide slots may engage with the tail ends of the locking members and may be formed such that the sliding movement of the plate causes the tail ends of the locking members to move in the slots so as to pivot the levers such that the locking ends move into and out of engagement with the plunger.

Preferably the locking surface of the plunger is formed by a set of flats.

The solenoid may be provided with circuit which indicates the status of the solenoid and thus whether the switch is open or closed. The circuit may be operable contacts which are fixed to the pivotal arm such that they are open and closed by movement of the solenoid plunger.

An embodiment of the present invention will now be described, by way of example, with reference to the accompanying drawings, in which.

Figure 4:
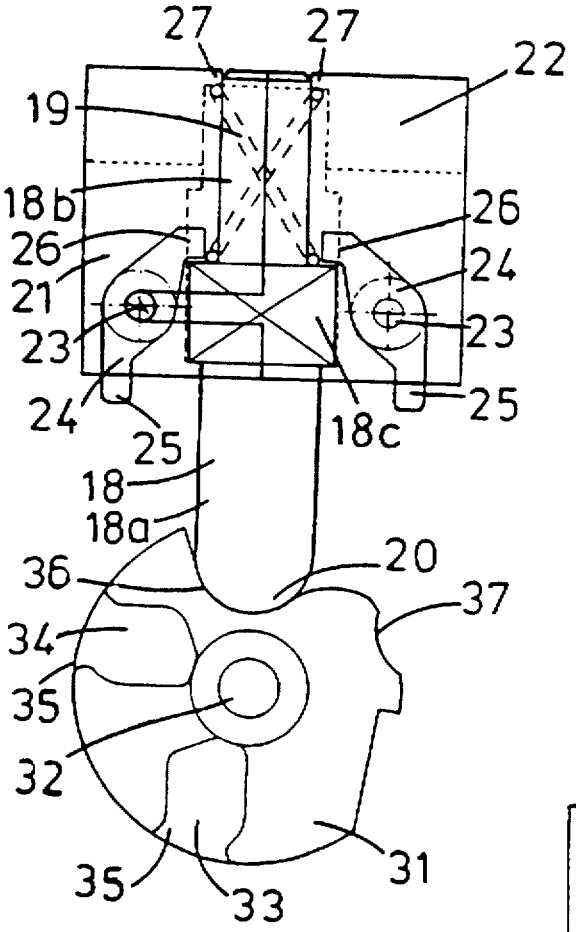
FIG. 4 is a side view of an actuating cam, push rod and locking lever assembly of an embodiment of the present invention in the switch on position.
Figure 5:
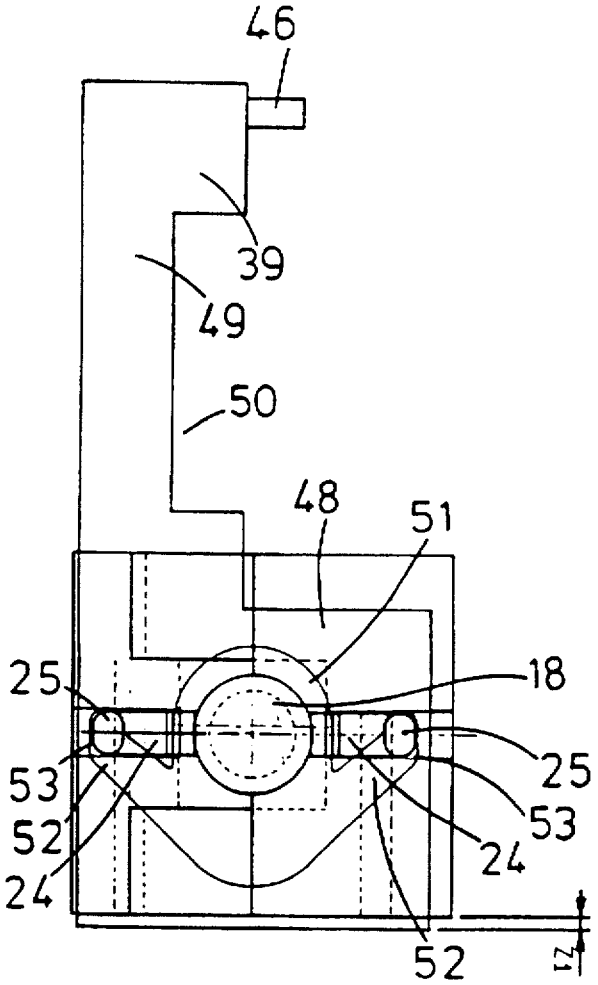
FIG. 5 is a rear view of a solenoid and sliding block assembly of the present invention in the switch on position.
Figure 7:
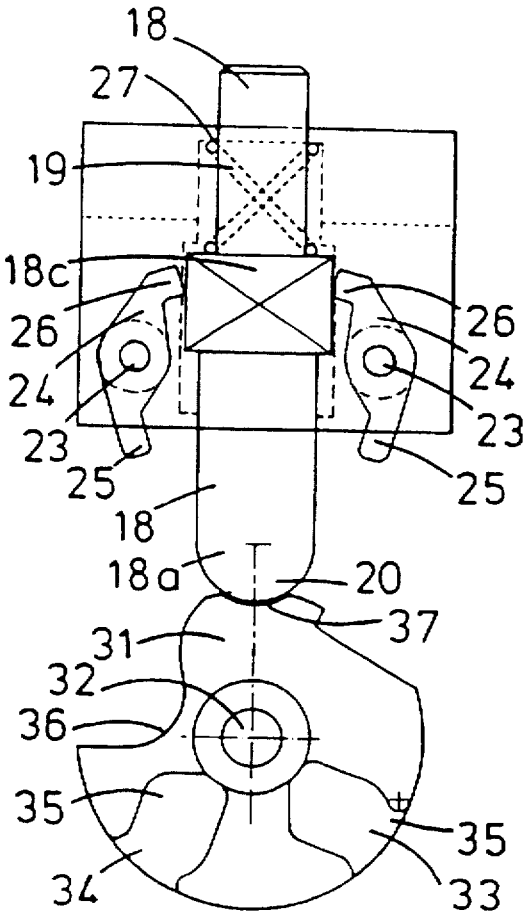
Figure 8:
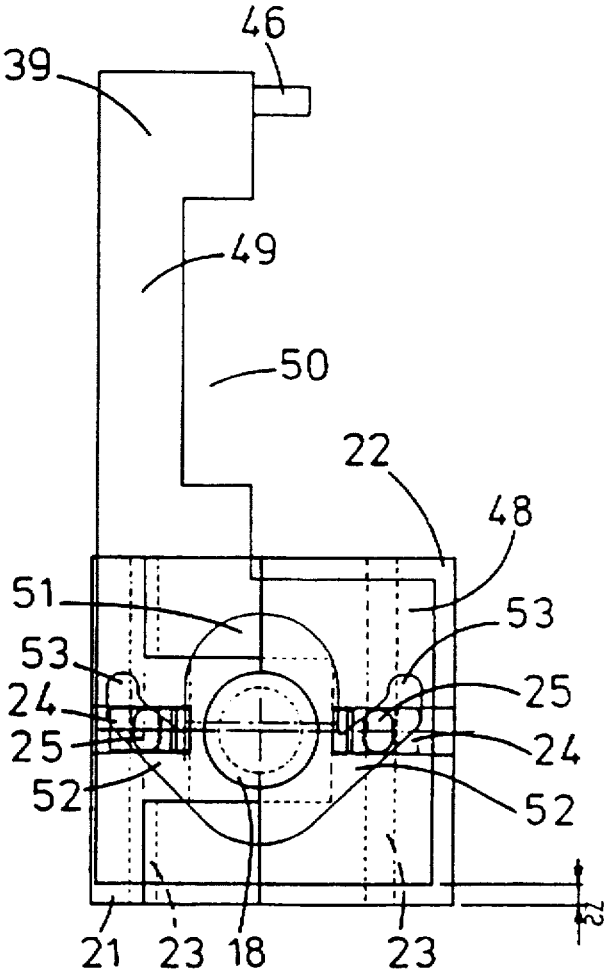

FIG. 7 corresponds to FIG. 4 with the switch in the off position;

FIG. 8 corresponds to FIG. 5 with the switch in the off position; and

Figure 6:
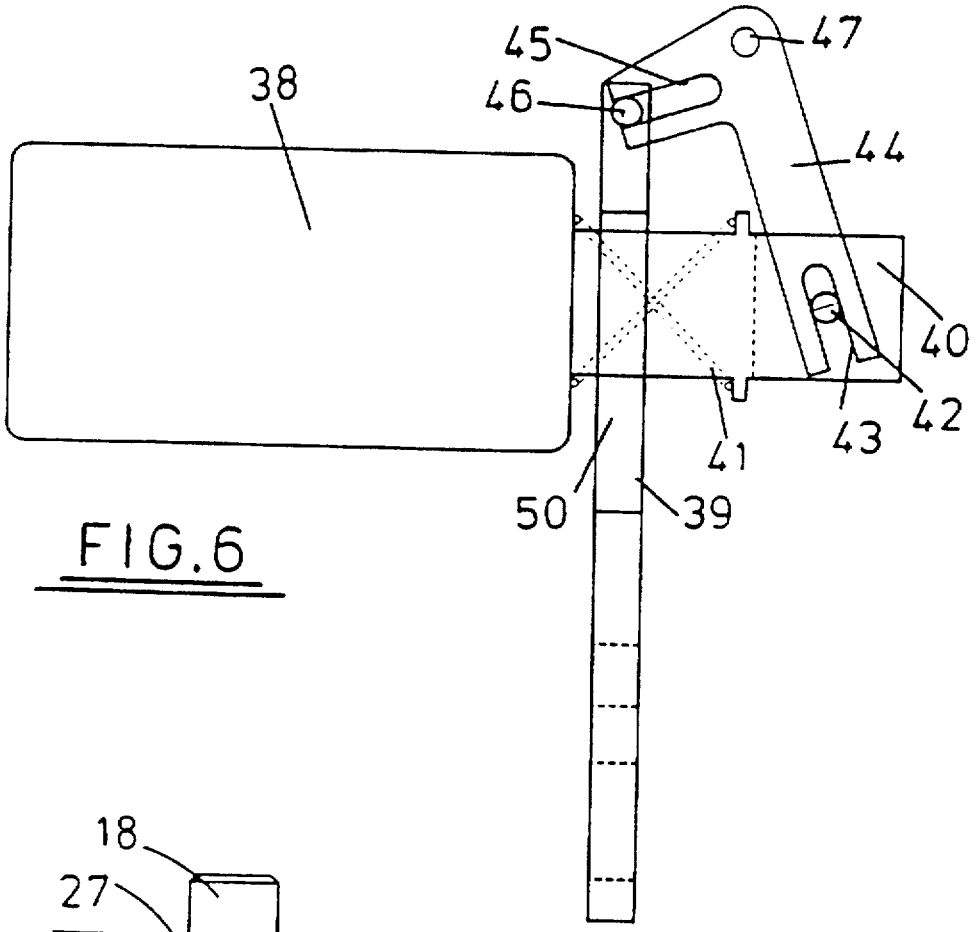
FIG. 6 is a front view of a sliding block, push rod and locking lever assembly of the present invention in the switch on position.
Figure 9:
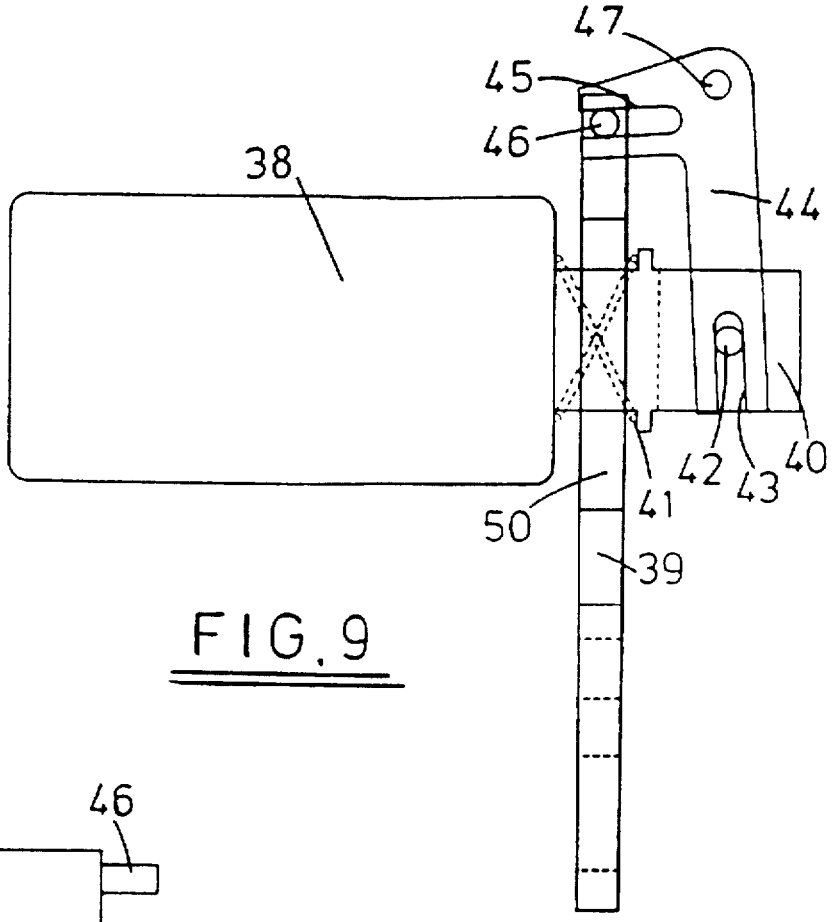

FIG. 9 corresponds to FIG. 6 with the switch in the off position.

Figure 1:
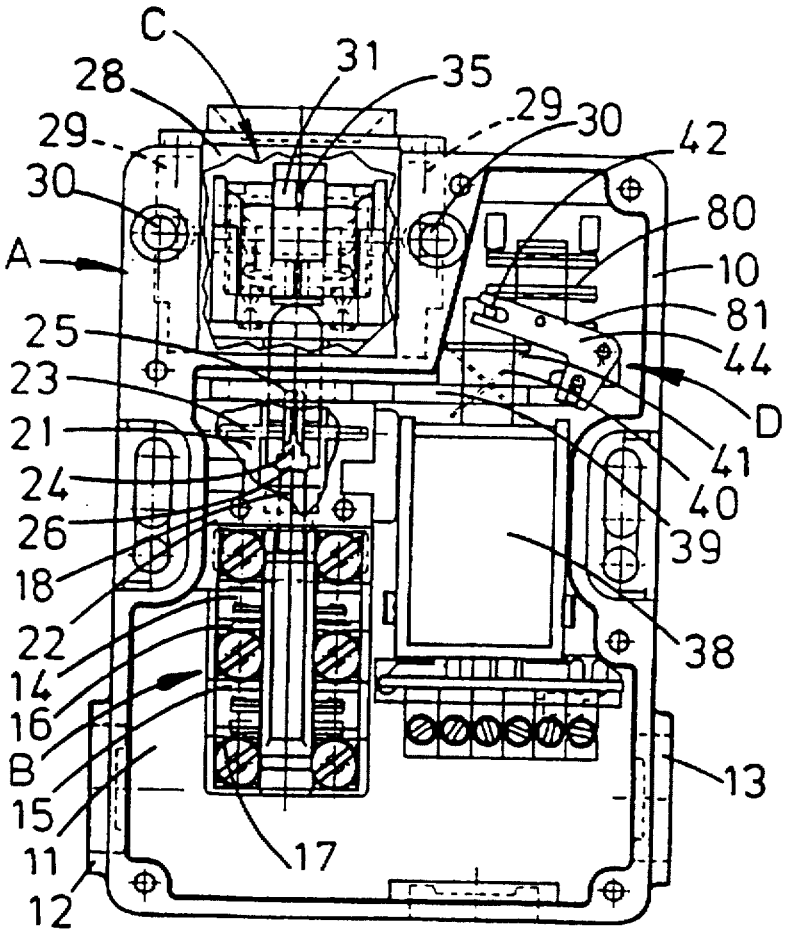
FIG. 1 is a front part cut-away view of a safety switch in accordance with the invention showing the electrical contact/actuating cam/locking members arrangement.

Referring to FIG. 1, the safety switch assembly comprises two components, namely the safety switch housing A which contains a conventional electrical contact arrangement B, a conventional operating cam arrangement C, and a solenoid, locking lever and sliding plate assembly D as will be described hereinafter. An actuator E (FIG. 2) operationally cooperates with the cam arrangement C also as hereinafter described.

The safety switch housing A comprises a glass reinforced nylon casing 10 which is self-extinguishing. The front of the casing 10 is shown open and is closeable by a faceplate (not shown), removable to permit access to the contact arrangement B and to the solenoid ad sliding plate assembly D.

Conduit entry parts 12,13 are provided for passage of a conduited electrical cable (not shown) into a contact compartment 11 for securement to the contact arrangement B.

The contact arrangement has contacts 14,15,16,17. The making of contacts 14, 15 and the breaking of contacts 16, 17 and vice versa, is effected by an axially moveable push rod 18, associated compression spring 19 and the cam arrangement C by which the push rod 18 is moved as later described.

The push-rod 18 has two parts 11*a*,18*b* of differing diameters interconnected by flats 18*c* which torn a four-faced block (see FIGS. 4 and 7). One end 18*b* of the push-rod 18 abuts the contact arrangement B and the other 18*a* which has a hemispherical end 20, abuts the cam arrangement C.

The push-rod 18 is slidably supported between two mating blocks 21, 22 (block 22 shown cut away in FIG. 1) each of which support a shaft 23 on which locking levers 24 are pivotally mounted. The shafts 23 are aligned in parallel on opposite sides of the push-rod 18 perpendicular to the longitudinal axis of the push-rod 18. Each locking lever 24 has a tail end 25 and an enlarged end 26 which is locatable under the flat 18*c* of the push-rod as shown in FIG. 4.

The compression spring 19 is mounted on the smaller part 18*b* of the push-rod 18 and extends between a ledge 27 formed on each of the blocks 21,22 and the underside of the flats 8*c*.

The cam arrangement C contained in housing 28 is of a known design and is not described in detail here. The housing 28 (shown cut-away in FIG. 1) has apertured flanges 29 (shown in dotted line) which are insertable into corresponding slots in the casing 16 so that the apertures in the flanges 29 align with corresponding apertures 30 in the casing. Pins (not shown) are then insertable through the two sets of apertures to hold the housing 28 to the casing 10.

In broad terms, the cam arrangement C inside the housing 28 comprises an actuator cam 31 mounted on a shaft 32 supported at its ends in the apertures in the walls of the housing 28, which shaft 32 extends through a central hole in the actuator cam 31.

The actuator cam 31, shown in detail in FIGS. 4 and 7 is generally of circular configuration, and is rotatable about the shaft 32. In the lower half (as depicted in FIGS. 4 and 7) of the actuator cam 31 there is formed a pair of radial cut-outs or pockets 33,34 open to the periphery of the actuator cam 31, extending inwardly towards the shaft 31 and spaced angularly one to another. The pockets 33,34 do not extend across the full thickness of the cam 31 but have a central bridge 35, and they are normally open to the top of the safety switch A. In the half of the cam 31 opposite the pockets 33,34 there is formed a deep arcuate recess 36 and a shallow arcuate recess 37.

The larger end of the axial push-rod 18 opposite the contact arrangement B extends into the housing 28 to abut the upper half of the cam 32 as shown in FIGS. 4 and 7. The recesses 36,37 are shaped to receive the hemispherical end 20 of the push-rod 18.

To one side of the push-rod 18 and contact arrangement B in the casing there is a solenoid 38 which actuates a sliding plate 39 to control the pivoting of the locking levers 24 as described later. The solenoid 38 has a plunger 40 which is biased by compression spring 41 to an extended position (see FIGS. 1 and 6). When the solenoid is energized the plunger 40 is withdrawn against the bias of the spring 41 (see FIG. 9). The free end of the plunger 40 has a pin 42 which is received in a slot 43 in an end of a cranked arm 44. The other end of the an 44 defines a slot 45 to receive a pin 46 mounted on the eliding plate 39. The cranked arm 44 is pivotally mounted on a shaft 47 fixed in the casing 10.

The sliding plate 39 comprises a thin piece of material having a substantially square portion 48 with an elongate arm 49 extending therefrom (see FIGS. 5 and 8). The arm 49 has a central recess 50 which is designed to accommodate the solenoid plunger 40 as described later. The square portion 48 of the plate 39 has a cut-out shape in the form of an ellipse 51 with two outwardly extending angled slots 52 on either side of the ellipse 51 at one end. The slots 52 extend at an angle from the end of the ellipse 51 towards the top and bottom edges of the plate 38 and end in a short rebate 53 which is substantially parallel to the top and bottom edges of the plate 39. The tail ends 25 of the locking levers 24 are received in the guide slots 52 and the push-rod 18 is received in the cut-out 51. At the end of the arm 49 remote from the square portion 48 there is an upwardly extending pin 46 which is pivotally received in slot 45 of the cranked arm 44 as described above.

As can be seen from FIG. 1 the sliding plate 39 is positioned such that it is perpendicular to the push-rod 18 and the solenoid plunger 40. The push-rod 18 is received in the elliptical cut-out 51 of the square portion 48 and the solenoid plunger 40 is accommodated in the cut-out recess 50 in the arm 49. Actuation of the solenoid plunger 40 causes the sliding plate 39 to move rectilinearly, the ellipse 51 and cut-out recess 50 permitting movement of the plate 39 perpendicular to the longitudinal axes of the plunger 40 and push-rod 18.

Figure 2:
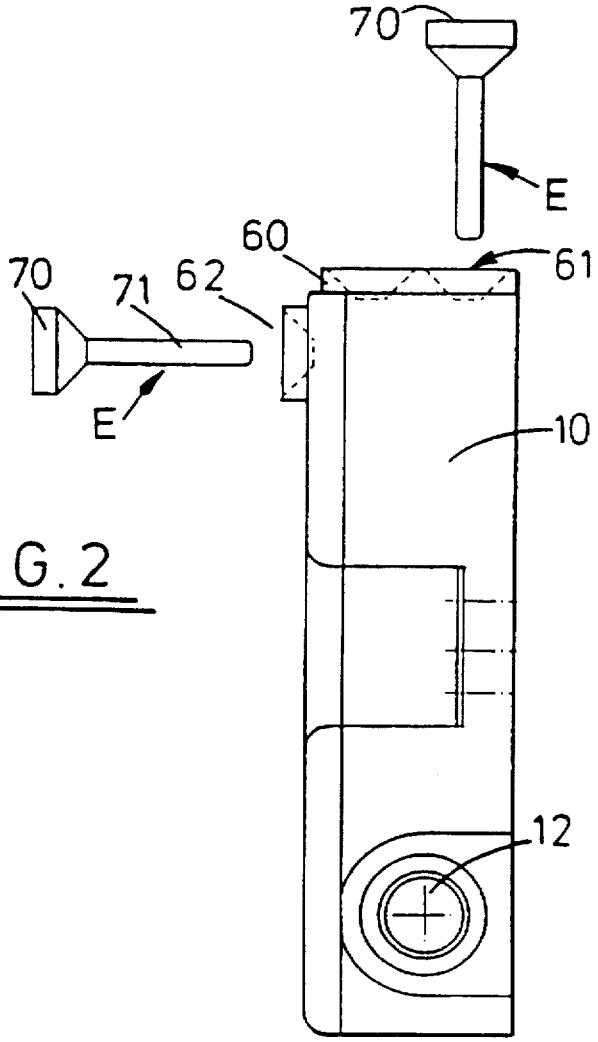
FIG. 2 is a side view of the switch of FIG. 1 with actuator shown.
Figure 3:
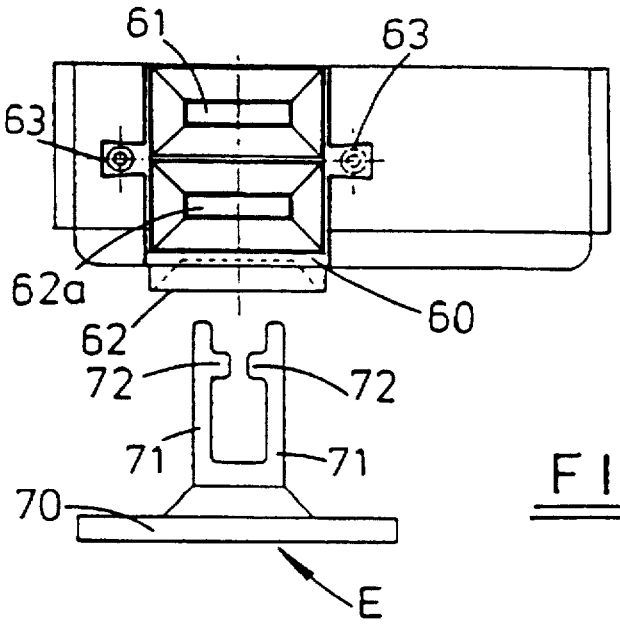
FIG. 3 is an end view of the switch of FIG. 1 with actuator shown.

An and cap 60, formed at one end of the casing attached to the hour 28, has rectangular openings 61,62 defining actuator entry slots (see FIGS. 2 and 3). Entry slots 61 and 62*a* are located on an and face of the housing A, whereas the slot 62 is located on the front face of the housing A. The cap 60 has two lugs 63 which are screw fitted to the flanges 29 of the cam housing 28.

Actuator entry 61 is aligned with the pocket 34 of the actuator cam 31 whereas actuator entry 62 is aligned with pocket 33 of the actuator cam 31.

The other component of the safety switch, namely the actuator E (see FIGS. 2 and 3) is formed, for example of stainless steel. It comprises a mounting bar 70, from which project two parallel actuating limbs 71 which are partially bridged by lugs 72 parallel to the mounting bar 70.

The above described safety switch can be used, inter alia, in connection with machinery guards, the safety switch housing A being mounted on the guard housing and the actuator E on the guard gate or door which may be hinged, sidable or of lift-off construction.

A pair of contacts 80,81 are associated with the solenoid 38 and are operated by the cranked arm 44 which is connected to a plate on which one set of contacts 80 is fixed. The contacts are connected to a circuit which provides an indication of the condition of the solenoid 38, that is "contacts closed" indicates that the solenoid is energized and that the machinery guard a be opened, "contacts open" indicates that the solenoid is not energized (i.e., de-energized) and that the machinery guard cannot be opened if in the closed state.

When the guard door or gate is closed, the actuator E enters the entry 61 or 62 depending upon the disposition of the safety switch. When the actuator enters entry 61 (see FIG. 2), the limbs 71 of the actuator E engage in the peripheral pocket 14 of the actuator cam 31, causing the latter to rotate and consequently the axial push-rod 18 to move axially under the influence of the spring 19 into the deep arcuate recess 36 of the cam 31. The contacts are thus closed, which condition will prevail as long as the actuator E is so engaged in the safety switch. In this condition the solenoid plunger 40 is in the extended position and the sliding plate 39 is held in position whereby the tails 25 of the locking levers 24 are located In the rebates 53 of the guide slots 52. The sliding plate 39 extends beyond the lever support blocks 21,22 by a distance Z1 (see FIG. 5) and, as the tail ends 25 are held apart by the sliding plate 39, the enlarged ends 26 of the levers 24 are held under the edge of the flat 18*c* of the push-rod 18 adjacent its smaller and 18*b*. The push-rod 18 is thus prevented from moving away from the cam 31. The rebates 53 thus prevent the locking leers 24 from pivoting on their respective shafts 23 to release the push-rod 18. In this position the contacts 14,15 are closed and the machinery is on.

If the actuator E is positioned to enter in the entry 62 the actuator limbs 71 and lugs 72 engage in the other peripheral pocket 33 to rotate the actuator cam 31 as before.

Retraction of the actuator E out of the safety switch housing A is, in both the above cases, prevented by the locking levers 24 which hold the push-rod 18 in the deep recess 36 of the actuating cam 31, preventing rotation of the latter and hence removal of the actuator E. In order to release the actuator E and turn off the power supply to the machinery, it is neo to release the push-rod 18 to allow the cam 31 to rotate.

Release of the push-rod 18 is achieved by energizing the solenoid 38 by for example a control button (not shown). Thus the safety door can only be opened when the button is depressed to actuate the solenoid 38. The same button could be used for example to turn off machinery within the enclosure. When energized (see FIG. 9) the plunger 40 of the solenoid 38 is withdrawn and the cranked arm 44 pivots about fixed pin 47 to move the sliding plate 39 a distance Z1+Z2 (where Z2 is the length of travel of the plate beyond the edge of the support blocks 21,22 (as depicted in FIGS. 5 and 8). As the sliding plate 39 moves, the tails 25 of the locking loves 24 are forced to follow ,the path of the slot 52 and pivot inwardly towards the push-rod 18, causing the outward movement of the engaging ends 26 away from the flats 18*c* of the push-rod 18. The push-rod 18 is then free to move and as the actuator E is retracted out of the safety switch housing A by opening the safety door or guard the cam 31 is rotated. Rotation of the cam 31 during retraction forces the push-rod 18 to move axially against the bias of the spring 19 until it rests in the shallow recess 37 of the cam 31 and the small end 18*b* of the pushod 18 protrudes from the supporting blocks 21,22 into the contact block assembly B to separate the contacts in the OFF position.

The actuator cam 45 rotation is unidirectional in both cases irrespective of which entry slat is entered by the actuator E.

If the gate or door of the machinery guard is open only slightly, say, for example, 6 mm this will force disconnection of the safety contacts in the event of contact weld and safety switch component failure thus providing complete operator safety.

The abovedescribed safety switch is installed by mounting the safety switch housing A at any convenient position of the machinery guard and the actuator E to an opening edge of the guard door or gate aligned with the entry 61 or alternatively the entry 62.

The actuating cam/sliding plate and push rod arrangement of the present invention can be used in and to operate electrical switches other than that described with reference to the drawings and consequently the present invention includes within its scope the actuator cam and locking member arrangement per se.

The safety switch assembly as described above provides for extra security in that a definite decision has to be made to open the machinery door or guard by pressing a control button or the like to operate the solenoid. The assembly also has the benefit of an indication of condition of the solenoid and hence whether the switch is locked in the door closed position or not.

It will be appreciated that the electrical switching contacts of the described embodiment of the invention could be supplemented by alternative control devices, for example a pneumatic valve or the like.

I claim:

1. A safety switch comprising:

electrical contacts switchable between power supply OFF and power supply ON conditions:

an actuating cam rotatable about a predetermined axis by an actuator of a predetermined configuration which may be inserted into and withdrawn from the safety switch, rotation of the cam resulting from insertion of the actuator causing movement of a cam plunger which moves the electrical contacts from the OFF position to the ON position and rotation of the cam resulting from withdrawal of the actuator causing movement of the cam plunger which moves the electrical contacts from the ON condition to the OFF condition; and a latch mechanism coupled to a solenoid, the latch mechanism being disposed to engage the cam plunger such that, when an attempt is made to withdraw the actuator fromthe safety switch, movement of the cam plunger is prevented by the latch mechanism and cam rotation is prevented by engagement between the cam plunger and the cam unless the solenoid is de-energized, wherein the latch mechanism is coupled to the solenoid by a linkage such that when the solenoid is de-energized, the latch mechanism is biased towards a cam plunger-engaging condition by the solenoid and, when the solenoid is energized, the latch mechanism is displaced by the solenoid to a cam plunger-releasing condition, the condition of the electrical contacts being independent of the energization state of the solenoid, the linkage includes a plate slidable between a first position and a second position and defines a cut-out which co-operates with the latch mechanism such that when the plate is in the first position, the latch mechanism is locked in the plunger-engaging condition and, when the plate is in the second position, the latch mechanism is in the cam plunger-releasing condition.

the plate is coupled to a plunger of the solenoid by a pivotal arm, the plunger having a surface, and the latch mechanism comprises at least one pivotally supported latch which is engageable with a surface of the plunger.

2. A safety switch according to claim 1, comprising two pivotally supported latches arranged on opposite sides of the cam plunger.

* * * * *